US006955274B2

(12) United States Patent
Delery et al.

(10) Patent No.: US 6,955,274 B2
(45) Date of Patent: Oct. 18, 2005

(54) FOOT OPERATED KNOCKDOWN LAUNDRY HAMPER AND BAG

(75) Inventors: Richard M. Delery, Laguna Niguel, CA (US); Marylou Foley, Laguna Niguel, CA (US)

(73) Assignee: The Bag Stand Company, Ontario (CA)

( * ) Notice: Subject to any disclaimer, the term of this patent is extended or adjusted under 35 U.S.C. 154(b) by 149 days.

(21) Appl. No.: 10/427,439

(22) Filed: May 1, 2003

(65) Prior Publication Data

US 2004/0217115 A1 Nov. 4, 2004

(51) Int. Cl.[7] ..... B65D 25/00
(52) U.S. Cl. ..... 220/9.4; 248/97; 383/7
(58) Field of Search ..... 220/4.28, 4.31, 220/4.33, 660, 668, 4.32, 9.4, 495.01, 495.06, 220/495.08, 495.11, 720, DIG. 14; 206/600; 232/1 B; 383/7, 22, 33, 87, 6; 248/95, 97, 248/99

(56) References Cited

U.S. PATENT DOCUMENTS 1,338,776 A * 5/1920 Jennings ..... 383/38
2,470,271 A * 5/1949 Steinbacher ..... 248/97
2,543,299 A * 2/1951 Pritchard ..... 383/7
2,789,610 A * 4/1957 Pritchard ..... 383/7
2,842,179 A * 7/1958 Hoeppner ..... 383/87
3,374,976 A * 3/1968 Kurlander et al. ..... 248/97
5,050,998 A * 9/1991 Wachtel ..... 383/6
5,503,476 A * 4/1996 Hamdan ..... 383/9
5,507,577 A * 4/1996 Fowler ..... 383/7

* cited by examiner

*Primary Examiner*—Stephen K. Cronin
*Assistant Examiner*—Harry Grosso
(74) *Attorney, Agent, or Firm*—Blackwell Sanders Peper Martin LLP

(57) ABSTRACT

A foot operated laundry hamper having a knock down frame and a special bag for the frame. Base sections of the frame include front and rear bars mounted on feet and side bars that are connected by coil springs. Detachable legs extending from the base support top sections having bars and arms on the side that detachably connect with the legs. A flexible laundry bag is provided on its top edge with pockets that fit snugly on the top bar sections. The springs normally hold the top bars together to close the top of the laundry bag. When the front bar on the base is depressed by a foot, the springs deform and pull the top bars apart to open the bag for the receipt of laundry. The frame disassembles for compact packaging.

11 Claims, 3 Drawing Sheets

FOOT OPERATED KNOCKDOWN LAUNDRY HAMPER AND BAG

CROSS-REFERENCE TO RELATED APPLICATIONS

None

STATEMENT REGARDING FEDERALLY SPONSORED RESEARCH OR DEVELOPMENT

None.

FIELD OF THE INVENTION

This invention relates generally to the handling of laundry and deals more particularly with a laundry hamper that is characterized by a knockdown construction to facilitate packaging and by a simple foot operated mechanism for opening and closing the hamper. The invention also relates to a laundry bag that is specially constructed for use with the knockdown hamper frame.

BACKGROUND OF THE INVENTION

The handling of laundry in households and other places typically involves storing dirty laundry items in a hamper. In order to provide a large capacity for holding large amounts of laundry, hampers are often constructed in a relatively large size. However, large hampers occupy considerable space and are difficult to package and ship in a compact manner. Consequently, large hampers occupy excessive shelf space in retail stores, and shipping and handling of large packages also presents problems.

Although efforts have been made to provide laundry hampers that can be disassembled in order to reduce the size of their packaging, these efforts have not been wholly successful. Larger hampers have relatively large panels requiring packaging that is still larger than desirable for efficient handling, shipping and display in retail stores. Moreover, ordinary consumers often have such difficulty in assembling the disassembled hampers that they are averse to purchasing them for this reason alone.

Laundry hampers are also typically provided with hinged lids that must be opened by hand. If both hands are occupied by laundry that is being loaded into the hamper, as is often the case, opening the lid can become a problem. Further, the types of foot operated devices that have been proposed have been complicated, prone to malfunctions, and difficult to use.

SUMMARY OF THE INVENTION

The present invention is directed to a foot operated laundry hamper that is constructed using a knockdown frame that can be packaged in a relatively small carton and can be quickly and easily assembled without the need for advanced skills or special tools. The invention also features a simple and reliable foot operated mechanism for opening and closing the hamper and a unique laundry bag that is specially constructed for use with the hamper frame.

In accordance with a preferred embodiment of the invention, lightweight tubing is used for the construction of a knockdown laundry hamper frame. The frame includes a base constructed of front and back sections each of which includes a main bar and short side tubes on its opposite ends. Springs that serve as the opening and closing mechanism are used to detachably connect the front and back sections of the base together. Detachable legs are applied to the base and support on their upper ends C-shaped top bars of the frame that are detachable from the legs.

The frame is thus provided with a lightweight and sturdy construction, and the parts can be broken down for packaging in a compact carton or other container. There are no unduly long or unduly wide parts that create packaging or handling problems. At the same time, the components can be unpacked and quickly and easily assembled by average consumers who lack special skills or sophisticated tools.

Preferably, a unique laundry bag is provided having a special construction compatible with the frame. The bag may have pockets that can be fitted on the top bars of the frame in order to secure the bag in place and properly locate it for use. One or more partitions can be provided in the bag to separate it into different compartments to facilitate sorting of laundry items in the bag.

The springs act to normally hold the top bars together with the bag closed. When the front bar of the base is depressed by the foot, the springs flex to bow shaped configurations, and this flexure of the springs pulls the top bars apart to open the bag so that laundry can be loaded into it. When the bag is full, the pockets can be slipped off of the top bars so that the bag can be removed for transport or other handling of the laundry.

BRIEF DESCRIPTION OF THE DRAWING

In the accompanying drawings which form a part of the specification and are to be read in conjunction therewith and in which like reference numerals are used to indicate like parts in the various views.

DETAILED DESCRIPTION OF THE INVENTION

Figure 2:
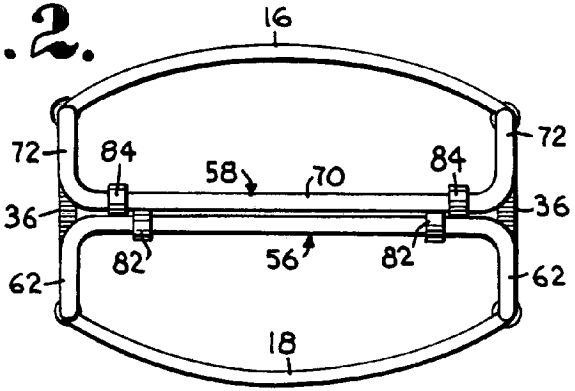
FIG. 2 is a top plan view of the hamper shown in FIG. 1.

Referring now to the drawings in more detail, numeral 10 generally designates a laundry hamper constructed according to a preferred embodiment of the present invention. The hamper 10 is provided with a frame which is generally identified by numeral 12 and which is a knockdown frame that can be assembled and disassembled. The frame 12 is preferably constructed of rigid lightweight tubing, although different constructions can be employed.

The hamper frame 12 includes a base that rests on the floor or other supporting surface and includes a front base section 14 and a rear base section 16. The front section 14 includes a curved front bar 18 that is provided on its opposite ends with vertical sleeves 20. A pair of short side bars 22 extend rearwardly from the sleeves 20. The bars 18 and 22 and the sleeves 20 are preferably formed as a single integral unit.

The rear base section 16 has a construction similar to that of the front section 14. The rear section 16 has a curved rear bar 24 that is provided on its opposite ends with sleeves 26. Short side bars 28 extend forwardly from the sleeves 26.

Figure 1:
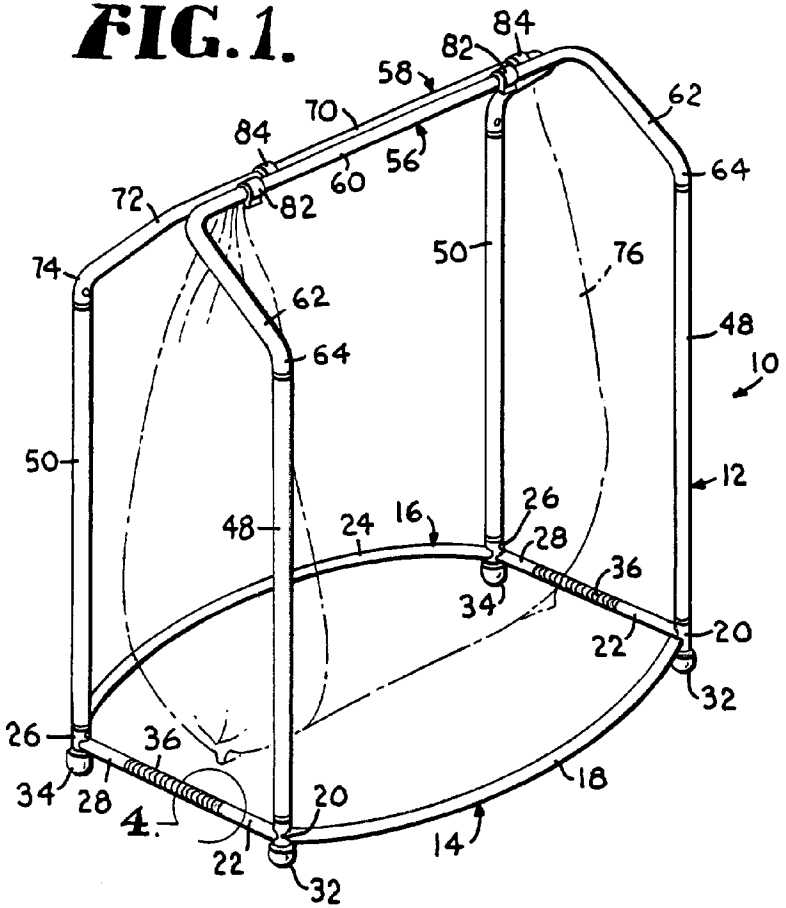
FIG. 1 is a perspective view of a knockdown laundry hamper constructed according to a preferred embodiment of the present invention, with the hamper in its closed position and a laundry bag shown in broken lines.
Figure 5:
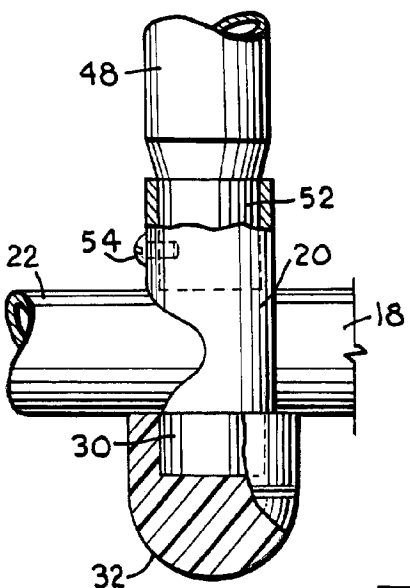
FIG. 5 is a fragmentary elevational view on an enlarged scale showing one of the corners of the base frame of the hamper.
Figure 7:
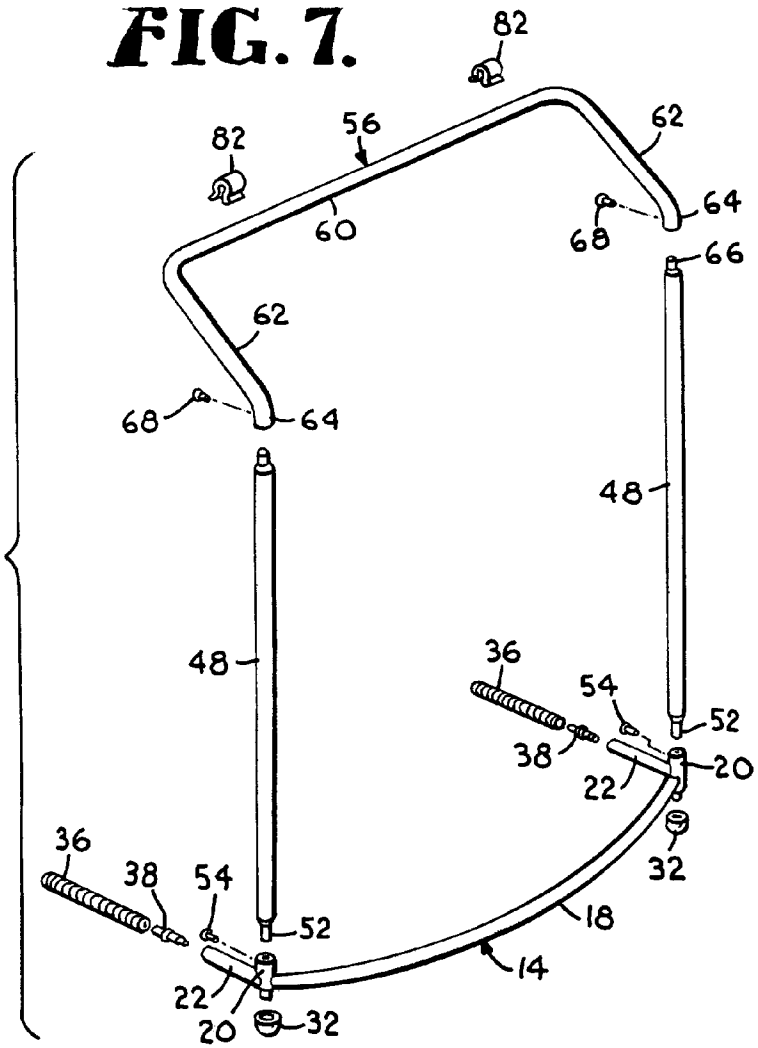
FIG. 7 is a partial exploded perspective view of part of the hamper frame depicting how the parts can be assembled and disassembled.

As shown in FIGS. 5 and 7, the bottom end of each sleeve 20 is provided with a downwardly projecting pin 30. Feet 32 which may be constructed of rubber or a similar material are press fit onto the pins 30 in order to detachably mount the feet 32 to the front frame section 14. A pair of rear feet 34 (see FIG. 1) are similarly mounted detachably on the lower ends of the rear sleeves 26.

Figure 4:
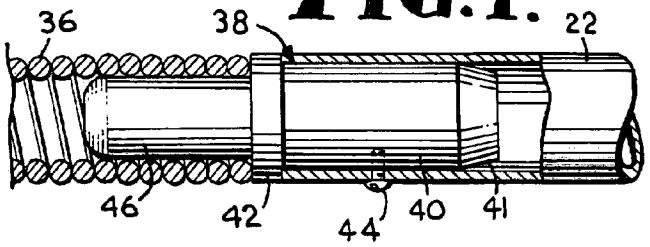
FIG. 4 is a fragmentary sectional view on an enlarged scale of the detail identified by numeral 4 in FIG. 1.

The side bars 22 and 28 on the front and rear base sections are connected to one another on opposite sides of the frame 12 by coil springs 36. With particular reference to FIG. 4, a fitting generally identified by numeral 38 has on one of its ends a cylindrical plug 40 that may be fitted closely yet detachably in the rear end of each of the tubular side bars 22. The tip 41 of plug 40 is tapered to facilitate its insertion into bar 22. The plug 40 is inserted into the bar 22 until an enlarged collar 42 formed on a mid portion of the fitting 38 is butted against the end of the bar 22. A screw 44 or other fastener can be inserted through the bar 22 and threaded into plug 40 in order to secure the fitting 38 detachably to the bar 22. One end of spring 36 is fitted closely yet detachably onto a pin 46 which projects from collar 42 in a direction opposite the plug 40.

The back end of each spring 36 is similarly secured detachably to the corresponding rear side bar 28, preferably making use of a fitting similar to the fitting 38. In this manner, the springs 36 provide connections on the opposite sides of the frame between the front base section 14 and the rear base section 16.

The frame 12 includes a pair of front legs 48 and a pair of rear legs 50. As best shown in FIGS. 5 and 7, the lower ends of the front legs 48 are provided with downwardly projecting pins 52 that are reduced in diameter compared to the main portion of leg 48. The pins 52 may be fitted closely yet detachably in the upper ends of the sleeves 20 and secured by detachable fasteners such as screws 54 that may be extended through the sleeve 20 and threaded into the pin 52. This secures each of the front legs 48 to the front base frame 14, with the legs 48 located at the opposite ends of the front bar 18 to extend upwardly parallel to one another on apposite sides of the frame 12.

The rear legs 50 may be detachably secured to the rear sleeves 26 in substantially the same manner. The rear legs 50 are thus mounted to the rear base section 16 to extend upwardly from the opposite ends of the rear bar 24.

The top portion of the hamper frame 12 is formed by a C-shaped front section 56 and a C-shaped rear bar section 58. The front bar section 56 includes a main bar 60 and a pair of parallel arms 62 extending from the opposite ends of bar 60. The arms 62 terminate in downwardly turned ends 64.

Figure 6:
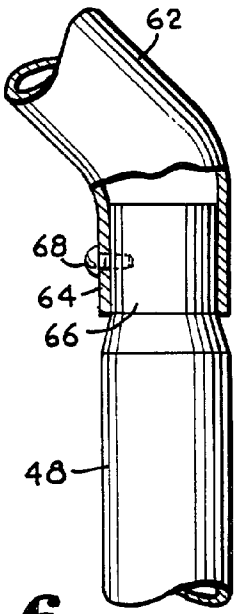
FIG. 6 is a fragmentary elevational view on an enlarged scale showing the connection of one of the top bars with one of the legs of the hamper frame.

As best shown in FIGS. 6–7, the down turned ends 64 of arms 62 are fitted closely on pins 66 that project upwardly from the top ends of legs 48. Suitable fasteners such as screws 68 may be extended through the ends 64 and threaded into the pins 66 in order to detachably secure the front bar section 56 on the top ends of the front legs 48.

The rear bar section 58 has a similar construction and attachment on the frame of the hamper. The bar section 58 includes a main bar 70 and a pair of parallel arms 72 extending from the opposite ends of bar 70. Each arm 72 terminates in a down turned end 74. The free ends 74 of arm 72 are detachably connected with the top ends of the rear legs 50 in the same manner as described previously for the front bar section. The bars 60 and 70 are parallel to one another when the bar sections 56 and 58 are in place on the hamper frame 12.

A flexible laundry bag 76 may be used with the hamper frame 12. The bag 76 has an upper edge 78 which presents an opening 80 (FIG. 3) through which laundry may be loaded into and removed from the bag 76. A front portion of the top edge 78 may be secured to the front top bar 60 by applying a pair of detachable clips 82 to the front edge of the bag and around the bar 60. The back edge portion of the edge 78 may similarly be secured to the rear top bar 80 by another pair of detachable clips 84.

The hamper frame 12 is knocked down or disassembled for packaging, shipment and display in retail stores. The top bar sections 56 and 58 are detached from the legs 48 and 50, and the legs 48 and 50 are in turn detached from the front and rear base sections 14 and 16. The front and rear base sections are detached from one another, with the springs 36 removed from the pins 46. The plugs 38 may be attached to the side bars 22 and 28 at the factory, or detached if desired.

The components of the frame 12 may be packaged in a relatively small carton because there are no unduly lengthy parts or unduly wide parts as is the case with hampers having a panel construction or other types of constructions.

The frame 12 may be unpacked and assembled quickly and easily by the purchaser without the need for special skills or sophisticated tools. The base of the frame is assembled by connecting the springs 36 to the pins 38, thus connecting the side bars 22 and 28 in line with one another. The feet 34 may be pressed onto the pins 30, and the legs 48 and 50 may be attached to the sleeves 20 and 26. The top bar sections 56 and 58 may be secured to the top ends of the legs 48 and 50 in the manner described. Finally, the bag 76 may be secured by clips 82 and 84 to the front and rear top bar sections 56 and 58.

In use of the hamper 10, the feet 34 support the frame and bag on a floor or other support surface. The springs 36 normally assume the straight conditions shown in FIGS. 1 and 2, and the spring force they exert on the frame holds the front and top bars 60 and 70 adjacent to one another in the closed position of the hamper shown in FIG. 1. In this position, the bag opening 80 is closed.

Figure 3:
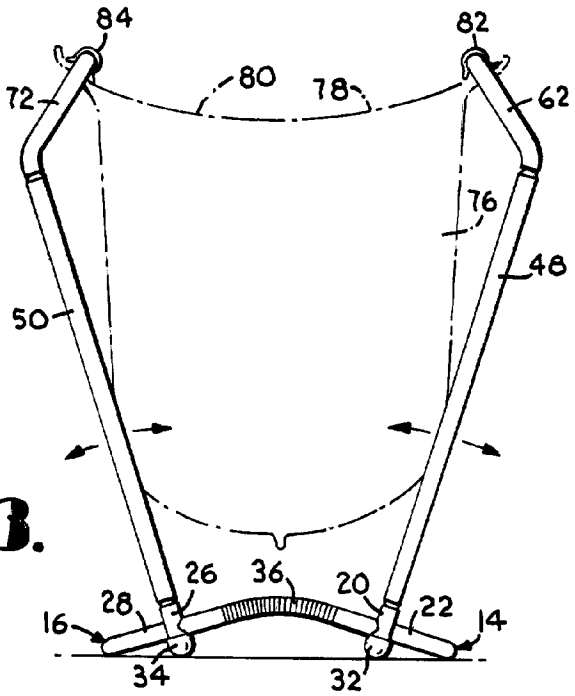
FIG. 3 is an end elevational view of the hamper in its open position, with the laundry bag shown open in broken lines.

In order to open the hamper 10, a user can step lightly on the front bar 18 of the front base section 14, and this pivots bars 22 upwardly to displace the springs 36 and cause them to assume the arched or bow shaped configuration shown in FIG. 3. The spring force exerted by the springs 36 in this configuration pulls the top bars 56 and 58 away from one another to the open position of the hamper shown in FIG. 3. In this position, bars 60 and 70 remain parallel to one another but are spaced apart in order to expose the bag opening 80 so that laundry can be inserted into the bag.

The bars 18 and 24 contact the floor to limit the extent to which the hamper can be opened. When the foot pressure is relieved, the springs 36 assume their normal straight configurations and pull bars 60 and 70 together to close the hamper The bag 76 can be detached from the hamper frame in order to handle laundry contained in the bag by detaching the clips 82 and 84. The bag 76 and the laundry it contains can then be carried away for handling of the laundry.

Figure 9:
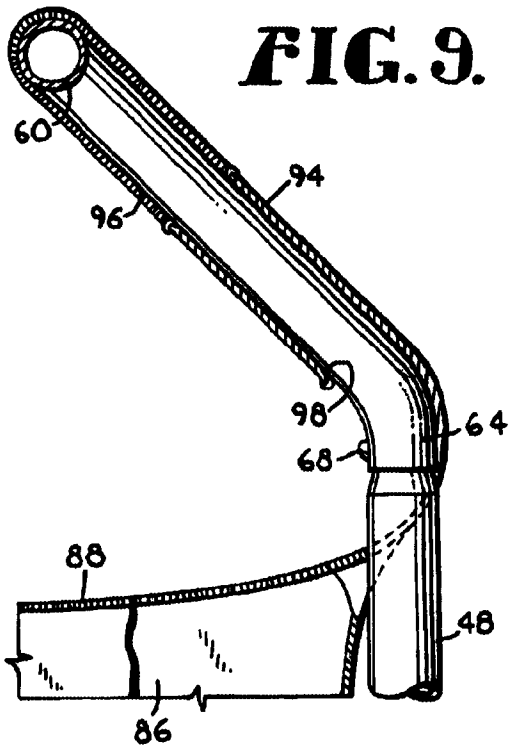
FIG. 9 is a fragmentary sectional view on an enlarged scale taken generally along line 9—9 of FIG. 8 in the direction of the arrows.
Figure 10:
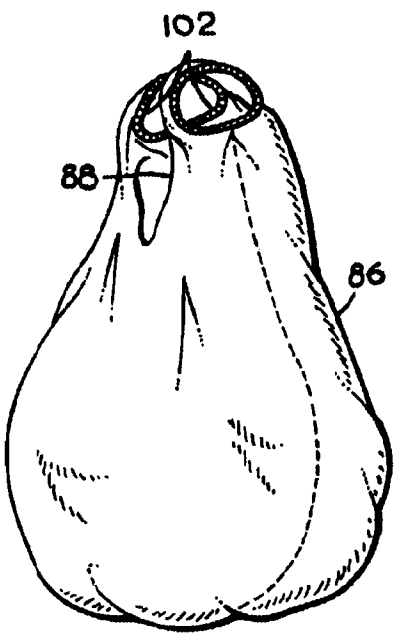
FIG. 10 is a perspective view showing the laundry bag of FIG. 8 loaded with laundry and removed from the hamper frame.
Figure 8:
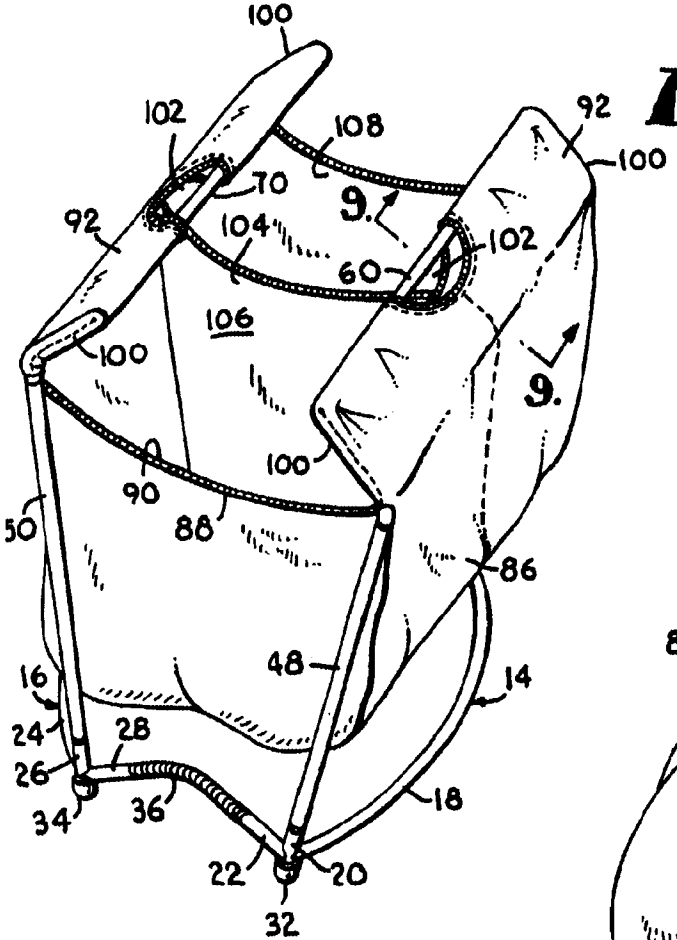
FIG. 8 is a perspective view showing the laundry hamper equipped with a modified laundry bag, with the hamper in the open position.

FIGS. 8–10 depict an alternative bag construction in which a flexible laundry bag 86 may be used in place of the bag 76. As best shown in FIG. 8, the bag 86 has an upper edge 88 that presents an opening 90 in the top of the bag through which laundry may be loaded into and unloaded from the bag. The front and back portions of the edge 88 are provided with pockets 92. As best shown in FIG. 9, each of the pockets 92 includes an outer panel 94 which essentially forms an extension of the front or back panel of the bag 86. Each pocket 92 is turned inwardly at the top of the front panel 94 to present an inside panel 96. At the bottom inside portion of each pocket 92, an opening 98 is provided in the pocket. Each pocket 92 has closed ends 100 FIG. 8 extending between the end edges of the panels 94 and 96. Openings 102 are provided near the center portion of each pocket 92 and extend through both panels 94 and 96. The bars 60 and 70 are exposed through openings 102 and provide convenient handles for moving the hamper.

The bag 86 is specially constructed for use with the knockdown hamper frame 12 of the present invention. In order to apply the bag 86 to the frame, the pockets are applied to the front and rear top bar sections 56 and 58 by applying the bottom openings 98 in the pockets over the top bars 56 and 58 and pulling the pockets 92 downwardly until the top portions of the pockets fit closely on the top bars 60 and 70. The ends 100 of the pockets 92 fit closely against the arms 62 and 72. In this manner, the pockets 92 are applied to the top bar sections 56 and 58 to fit tightly over the bar sections and hold the bag 86 in place on the hamper frame 12. The tight fit of the pockets 92 on the bar sections 56 and 58 holds the bag securely in place on the frame. The pockets 92 extend downwardly to approximately the top ends of the legs 48 and 50.

When the front bar 18 of the front base section 14 is depressed with the foot, the frame 12 moves to the open position in the manner described in connection with the embodiment shown in FIGS. 1–7. This pulls the top bars 60 and 70 apart and thus pulls the top end of the bag 86 open so that the top opening 90 is exposed in order to receive laundry. When the foot pressure is released on bar 18, the springs 36 revert to their straight conditions and thereby pull bars 60 and 70 together to the closed position in which the top opening 90 of bag 86 is closed.

The bag 86 can be removed by simply detaching the pockets 92 from the top bar sections 56 and 58. The openings 102 then provide convenient handles for carrying of the laundry bag 86 and the laundry it contains.

Either of the bags 76 or 86 can be provided with one or more internal partitions 104 (see FIG. 8) which serve to divide the interior of the bag into separate compartments such as the compartments 106 and 108 identified in FIG. 8. This allows the laundry items to be sorted conveniently by placing them in the separate compartments 106 and 108. It should be understood that two or more partitions such as the partition 104 can be provided so that three or more internal compartments can be formed within the laundry bag.

From the foregoing it will be seen that this invention is one well adapted to attain all ends and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative, and not in a limiting sense.

What the invention claimed is:

1. A laundry hamper comprising:

a base frame for application to a support surface, said base frame including a front section and a back section each having feet and opposite ends;

a pair of legs for each of said sections, said legs being applicable to the respective front and back sections to extend upwardly therefrom and being detachable from said sections;

a top bar unit for each of said sections applicable to the legs of the respective front and back sections and detachable from said legs;

a pair of springs arranged to detachably extend between the opposite ends of said front section and said back sections on opposite sides of the hamper, said springs having normal positions extending between said opposite ends in a generally straight condition to hold said bar units adjacent to one another in a closed position of the hamper and said springs flexing to bowed shapes to pull bar units away from one another in an open position of the hamper when one of said sections is depressed.

2. A laundry hamper as set forth in claim 1, including a flexible laundry bag having a pair of pockets arranged to closely receive said top bar units with the pockets in a taut condition to hold said bag, said bag having a top opening for receiving laundry which is held closed in said closed position of the hamper and open in said open position of the hamper.

3. A laundry hamper as set forth in claim 2, including a partition in said bag dividing the bag into a pair of separate compartments.

4. A laundry hamper as set forth in claim 1, wherein each of said top bar units has a C-shaped configuration and includes:

a pair of arms having ends arranged to connect detachably with said legs at upper ends of the legs; and a bar extending between said arms, said bars of the bar units being adjacent and substantially parallel in the closed position of the hamper and spaced apart and substantially parallel in the open position of the hamper.

5. A laundry hamper as set forth in claim 4, including:

a flexible laundry bag for receiving and holding laundry, said bag having an upper edge and a top presenting an opening;

a pair of pockets on said upper edge of the bag on opposite sides of said opening, said pockets being arranged to fit tightly on said bars and arms in a manner to expose said opening in the bag for the receipt of laundry in the open position of the hamper and to close said opening in the closed position of the hamper.

6. A laundry hamper as set forth in claim 5, including at least one partition in said bag dividing the bag into separate compartments located on opposite sides of said partition.

7. A laundry hamper as set forth in claim 1, wherein:

said front section includes a front bar and a pair of side bars on opposite ends of said front bar;

said back section includes a rear bar and a pair of side bars on opposite ends of said rear bar; and said springs are arranged for detachable connection between said side bars on the front bar and said side bars on the rear bar.

8. A laundry hamper as set forth in claim 7, wherein:

said side bars are tubular;

said springs have opposite ends; and said springs are connected detachably to said side bars by fittings arranged to fit in said springs and in said side bars.

9. A foot operated laundry hamper constructed for knock down assembly, said hamper comprising:

a front base section having a front bar presenting opposite ends provided with feet, said front bar having a pair of front side bars extending therefrom;

a pair of front legs having detachable connections with said opposite ends of said front bar to extend upwardly therefrom;

a front top bar having a detachable connection with said front legs at upper ends thereof;

a rear base section having a rear bar presenting opposite ends provided with feet, said rear bar having a pair of rear side bars extending therefrom;

a pair of rear legs having detachable connections with said opposite ends of said rear bar to extend upwardly therefrom;

a rear top bar having a detachable connection with said rear legs at upper ends thereof; and a pair of springs having detachable connections between said front side bars and said rear side bars, said springs each normally extending in a generally straight condition wherein said front top bar and said rear top bar are adjacent in a closed hamper position and said springs being flexible to bowed shapes to pull said front and rear top bars apart in an open hamper position when said front bar of the front base section is depressed.

10. A hamper as set forth in claim 9, including:

a flexible laundry bag having an upper edge presenting an opening;

a pair of pockets on said bag adjacent the upper edge thereof applicable to said front top bar and said rear top bar to retain said bag thereon, said opening being closed when said front and rear top bars are adjacent in the closed hamper position and said opening being exposed to receive laundry when said front and rear top bars are pulled apart in the open hamper position.

11. A hamper as set forth in claim 10, including:

a pair of arms on said front top bar; and a pair of arms on said rear top bar, said pockets fitting tightly on said arms.

* * * * *